US006416176B1

(12) United States Patent
Yasui et al.

(10) Patent No.: US 6,416,176 B1
(45) **Date of Patent: *Jul. 9, 2002**

(54) INK-JET PRINTING SYSTEM HAVING AN IMPROVED SHEET TRANSPORT MECHANISM

(75) Inventors: Motokazu Yasui; Masumi Sato, both of Kanagawa; Masato Yokoyama, Tokyo, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 14 days.

(21) Appl. No.: 09/375,988

(22) Filed: Aug. 16, 1999

(30) Foreign Application Priority Data

Aug. 19, 1998 (JP) ..... 10-232592

(51) Int. Cl.[7] ..... B41J 2/01
(52) U.S. Cl. ..... 347/104
(58) Field of Search ..... 347/104, 8; 346/134; 400/627; 271/193, 276

(56) References Cited

U.S. PATENT DOCUMENTS 4,207,579 A * 6/1980 Gamblin et al. ..... 346/134
4,237,466 A * 12/1980 Scranton ..... 346/134
4,463,361 A * 7/1984 Koumura et al. ..... 346/134
5,197,812 A * 3/1993 Worley et al. ..... 400/627

FOREIGN PATENT DOCUMENTS

| | | |
|---|---|---|
| JP | 5643653 | 4/1981 |
| JP | 56126184 | 10/1981 |
| JP | 4-31070 | 2/1992 |
| JP | 6080268 | 3/1994 |
| JP | 7125364 | 5/1995 |
| JP | 7132659 | 5/1995 |
| JP | 7137877 | 5/1995 |
| JP | 9024650 | 1/1997 |

* cited by examiner

*Primary Examiner*—John Barlow
*Assistant Examiner*—An H. Do
(74) *Attorney, Agent, or Firm*—Cooper & Dunham LLP

(57) ABSTRACT

An ink-jet printing system includes a print head which forms an image on a copy sheet at a print position by spraying ink onto the copy sheet through a nozzle of the head. A sheet transport mechanism transports the copy sheet along a sheet transport path while the image is formed on the copy sheet by the print head. The sheet transport mechanism includes a sheet guide member provided under the print head to guide the transport of the copy sheet, and includes a sheet attracting member which pneumatically attracts the copy sheet to the sheet guide member during the image forming.

9 Claims, 4 Drawing Sheets

INK-JET PRINTING SYSTEM HAVING AN IMPROVED SHEET TRANSPORT MECHANISM

BACKGROUND OF THE INVENTION (1) Field of the Invention

The present invention relates to an ink-jet printing system which includes a sheet transport mechanism in which a copy sheet at a print position is transported while an image is formed on the copy sheet by a print head.

(2) Description of the Related Art

In image forming systems, such as printers, facsimiles, or copiers, an image is created on a copy sheet. An ink-jet printing system is one of such image forming systems. In the ink-jet printing system, a print head forms an image on a copy sheet at a print position by spraying ink onto the copy sheet through a nozzle of the print head. The copy sheet may be a sheet of paper or a sheet of plastic material. In the ink-jet printing system, a sheet transport mechanism is provided to transport a copy sheet at a print position while the image is formed on the copy sheet by the print head. During the image forming, the print head moves across the copy sheet in a main scanning direction to draw one scan line, returns while the copy sheet is transported in a sub-scanning direction by one inter-scan-line spacing, and draws the next scan line.

Generally, in the above-described ink-jet printing system, the ink is sprayed onto the copy sheet, and slight irregularities in the flatness of the copy sheet that is transported during the image forming can arise. If the copy sheet is in a wavy or distorted condition during the image forming, the resulting image will contain a distortion. If the copy sheet is excessively slanted, the print head will be brought into contact with the copy sheet, which is detrimental to both the print head and the image quality. In order to obtain good quality of the reproduced image, it is desirable to stably hold the copy sheet in a flat condition relative to the print head during the sheet transport.

As disclosed in Japanese Laid-Open Patent Applications No. 7-125,364, No. 7-132,659 and No. 9-24,650, a sheet transport mechanism which uses rollers to pinch the copy sheet at upstream and downstream positions along a sheet transport path is known. However, when such rollers are arranged in an image forming system, an effective print range of the print head for the copy sheet will be too narrow due to the restriction of the layout of the entire system and the use of the rollers. As the rollers must be arranged adjacent to the print head, the top and bottom margins of the copy sheet where the image forming is impossible are relatively large.

Japanese Laid-Open Patent Application No. 7-125,364 discloses a dot-impact printer including first rollers, second rollers, and a flat-surface platen. A copy sheet is transported by the first and second rollers. The platen is arranged under the print head such that the platen and the print head confront each other via the copy sheet to print an image on the copy sheet against the flat surface of the platen. However, when such rollers and platens are arranged in the printer, an effective print range of the print head for the copy sheet will be too narrow due to the restriction of the layout of the entire system and the use of the rollers.

Japanese Laid-Open Patent Application No. 7-132,659 discloses a sheet ejection mechanism of an ink-jet printer. The copy sheet after the image is formed thereon is ejected out of the printer by an ejection roller and a spur roller. In order to avoid the ink stain in the copy sheet by the rollers which interfere with the copy sheet, the spur roller is arranged at a slightly upstream position from a position just above the outer periphery of the ejection roller. However, the mechanism of the above publication is inadequate to hold the copy sheet at the print position in a flat condition relative to the print head during the sheet transport.

Japanese Laid-Open Patent Application No. 9-24,650 discloses an ink-jet printer in which a copy sheet is transported along the periphery of a platen roller, and a part of the periphery of the platen roller is used as a print position where the ink is sprayed onto the copy sheet by the print head. A pinch roller and a star wheel are arranged at upstream and downstream positions on the periphery of the platen roller so as to press the copy sheet against the platen roller. The mechanism of the above publication is inadequate to hold the copy sheet in a flat condition relative to the print head during the sheet transport.

Further, a sheet transport mechanism which uses a transport belt to transport the copy sheet is known. For example, Japanese Laid-Open Patent Application No. 6-80,268 discloses a belt conveyer device which uses a transport belt running on rollers to transport a copy sheet within an image forming system. One of the rollers is improved to contain an elastic-material layer on a core shaft in order to reduce the deformation of the belt. The belt conveyer device of the above publication is applicable to various image forming systems such as printers, facsimiles or copiers. However, the belt conveyer device of the above publication is inadequate to hold the copy sheet in a flat condition relative to the print head during the sheet transport.

Japanese Laid-Open Patent Application No. 7-137,877 discloses a sheet transport mechanism in which a comb-form electrode pattern is provided under the surface of a transport belt. A bias voltage is supplied to the transport belt via the electrode pattern, so as to create an electrostatic attraction for the copy sheet which is transported by the transport belt. However, it is necessary that the transport belt comes in contact with the electrode pattern, and the load to drive the transport belt will be increased by the contact of the belt with the electrode pattern. The configuration of this mechanism is complicated and the cost will be raised. The conventional mechanism of the above publication is inadequate to avoid the occurrence of slight irregularities in the flatness of the copy sheet that is transported during the image forming.

Japanese Laid-Open Patent Application No. 4-31,070 discloses a sheet transport mechanism of an ink-jet printer in which a copy sheet is electrostatically attracted by a transport belt while it is transported. In order to reduce the load to drive the transport belt and maintain the speed of the belt at a constant level, a cleaning blade which is attached to the belt for cleaning purpose is detached from the transport belt when a start of image formation on the copy sheet is detected. However, the conventional mechanism of the above publication requires a sensor to detect the timing of the start of image formation and a control unit to detach the cleaning blade from the transport belt at the detected timing. The configuration of the sheet transport mechanism is complicated and such a mechanism is expensive.

SUMMARY OF THE INVENTION

An object of the present invention is to provide an ink-jet printing system including an improved sheet transport mechanism in which the above-described problems are eliminated.

Another object of the present invention is to provide an ink-jet printing system including a sheet transport mechanism which is constructed in a simple structure and stably maintains the copy sheet in a flat condition relative to the print head while transporting the copy sheet at the print position during the image formation.

The above-mentioned objects of the present invention are achieved by an ink-jet printing system including: a print head which forms an image on a copy sheet at a print position by spraying ink onto the copy sheet through a nozzle of the head; and a sheet transport mechanism which transports the copy sheet along a sheet transport path while the image is formed on the copy sheet by the print head, the sheet transport mechanism including a sheet guide member provided under the print head to guide the transport of the copy sheet, and including a sheet attracting member which pneumatically attracts the copy sheet to the sheet guide member during the image forming.

The above-mentioned objects of the present invention are achieved by an ink-jet printing system including: a print head which forms an image on a copy sheet at a print position by spraying ink onto the copy sheet through a nozzle of the head; and a sheet transport mechanism which transports the copy sheet along a sheet transport path while the image is formed on the copy sheet by the print head, the sheet transport mechanism including a transport belt which transports the copy sheet, the transport belt having a number of air vents formed therein, and the sheet transport mechanism including a sheet attracting member which pneumatically attracts the copy sheet to the transport belt, during the transport of the copy sheet, by generating a flow of air passing through the air vents of the transport belt.

In the ink-jet printing system of the present invention, the sheet transport mechanism is constructed in a simple structure, and it is effective in maintaining the copy sheet in a flat condition with respect to the print head while transporting it at the print position during the image formation. The limitation of an effective print range of the print head for the copy sheet due to the restriction of the layout of the entire printing system can be eliminated. It is possible to reliably prevent the copy sheet from being set in a wavy or distorted condition during the image forming, and this makes it possible to obtain good quality of the reproduced image.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 1:
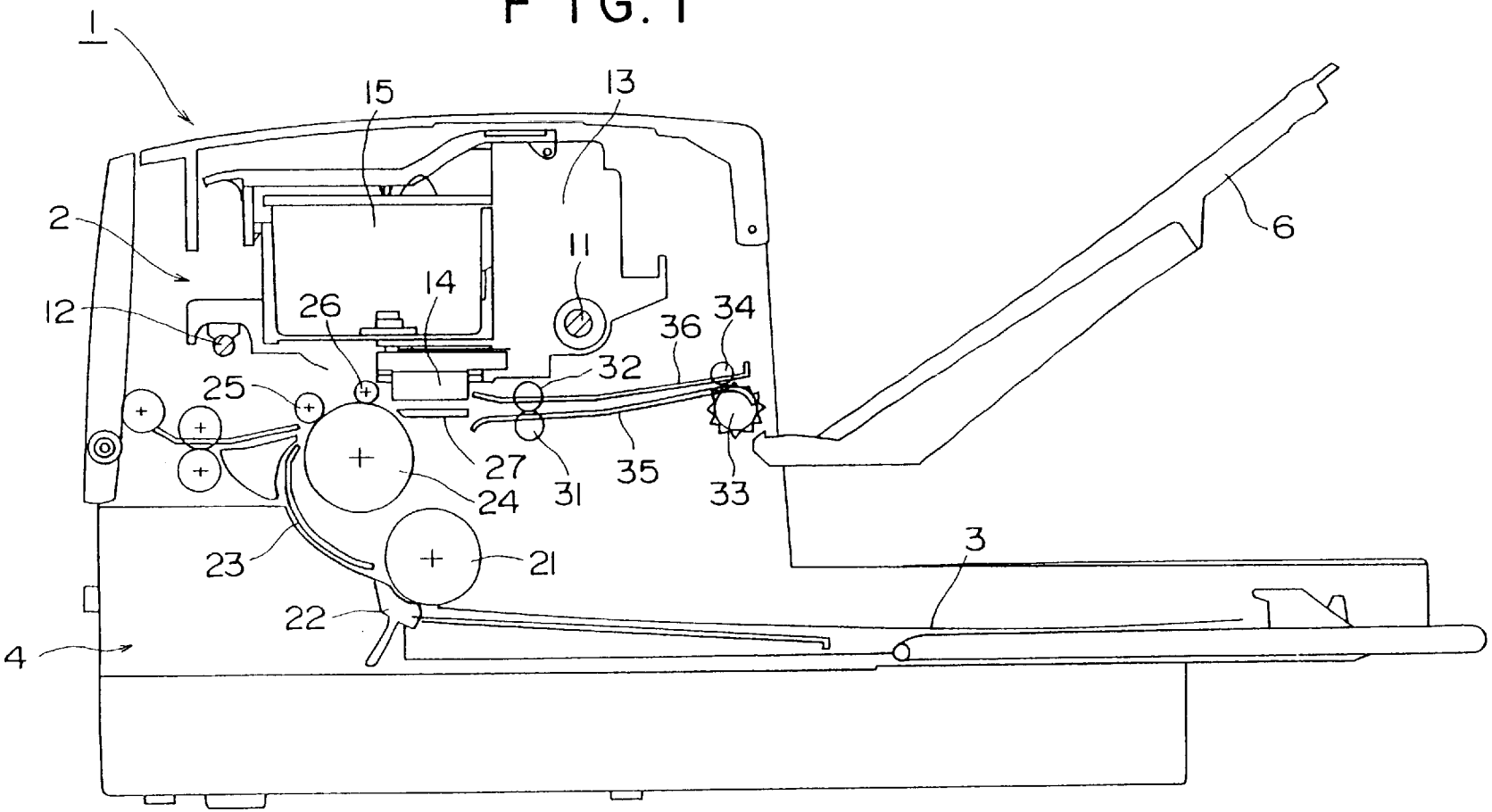
FIG. 1 is a cross-sectional view of an ink-jet printing system to which an embodiment of the present invention is applied.

FIG. 1 shows an ink-jet printing system to which an embodiment of the present invention is applied.

As shown in FIG. 1, the ink-jet printing system generally has a main component 1 which contains the elements of the system, and a printing mechanism 2 which is accommodated in the main component 1. In the printing mechanism 2, there are provided a carriage 13 which is movable in a main scanning direction (which is perpendicular to the paper of FIG. 1), a print head 14, such as a set of ink-jet segment chips, which is mounted on the carriage 13, and ink cartridges 15 which supply respective inks to the print head 14.

In the ink-jet printing system of FIG. 1, a sheet cassette 4 (or a sheet-supply tray) which can contain a number of copy sheets therein is attached to the main component 1. The sheet cassette 4 is removably attached to a lower portion of the main component 1. A copy sheet 3, sent from the sheet cassette 4, is delivered to a print position under the printing mechanism 2, an image is formed on the copy sheet 3 at the print position by the printing mechanism 2, and the copy sheet 3 with the image formed is ejected to an ejection tray 6. In the present embodiment, the ejection tray 6 is attached to a rear surface of the main component 1.

In the ink-jet printing system of FIG. 1, the carriage 13 is held by a main guide rod 11 and a sub-guide rod 12 such that the carriage 13 is movable in the main scanning direction perpendicular to the paper of FIG. 1. The main guide rod 11 and the sub-guide rod 12 are transversely extending, and they are secured to right- and left-side walls (not shown) of the main component 1. The print head 14 is supported on a bottom surface of the carriage 13. In the present embodiment, the print head 14 is constituted by a set of ink-jet segment chips, namely, cyan, magenta, yellow and black segment chips. Each of the segment chips has a nozzle through which each respective ink is sprayed onto a copy sheet, and the nozzles of the segment chips face to the downward direction of the carriage 13. The ink cartridges 15 are mounted on an upper portion of the carriage 13, so that the ink cartridges 15 supply the respective inks to the print head 14. The ink cartridges 15 can be replaced by new ones.

In the present embodiment, the ink-jet segment chips having the respective nozzles in the print head 14 are arrayed in parallel to the main scanning direction. Alternatively, a multi-nozzle print head may be used instead.

In the ink-jet printing system of FIG. 1, a sheet-delivery roller 21 and a friction pad 22 are provided to deliver one of the number of copy sheets from the sheet cassette 4, to a sheet guide path 23. This copy sheet will be called the copy sheet 3. The sheet guide path 23 is provided to guide the transport of the copy sheet 3, sent from the sheet cassette 4, to an intermediate roller 25. The intermediate roller 25 is provided on the periphery of a main transport roller 24. The main transport roller 24 and the intermediate roller 25 act to turn the copy sheet 3 upside down and to deliver it to an intermediate roller 26. The intermediate roller 26 is also provided on the periphery of the main transport roller 24 at a downstream position away from a position of the intermediate roller 25.

In the ink-jet printing system of FIG. 1, the main transport roller 24, the intermediate roller 26 and a sheet guide member 27 are provided to transport the copy sheet 3 at the print position in a sub-scanning direction (which is perpendicular to the main scanning direction) during the image formation by the print head 14. The position of the intermediate roller 26 around the periphery of the main transport roller 24 serves to define the direction to move the copy sheet 3 apart from the main transport roller 24 toward the sheet guide member 27. In the present embodiment, the copy sheet 3 at the print position is pneumatically attracted by a sheet attracting member during the transport of the copy sheet 3, which will be described later.

Figure 2:
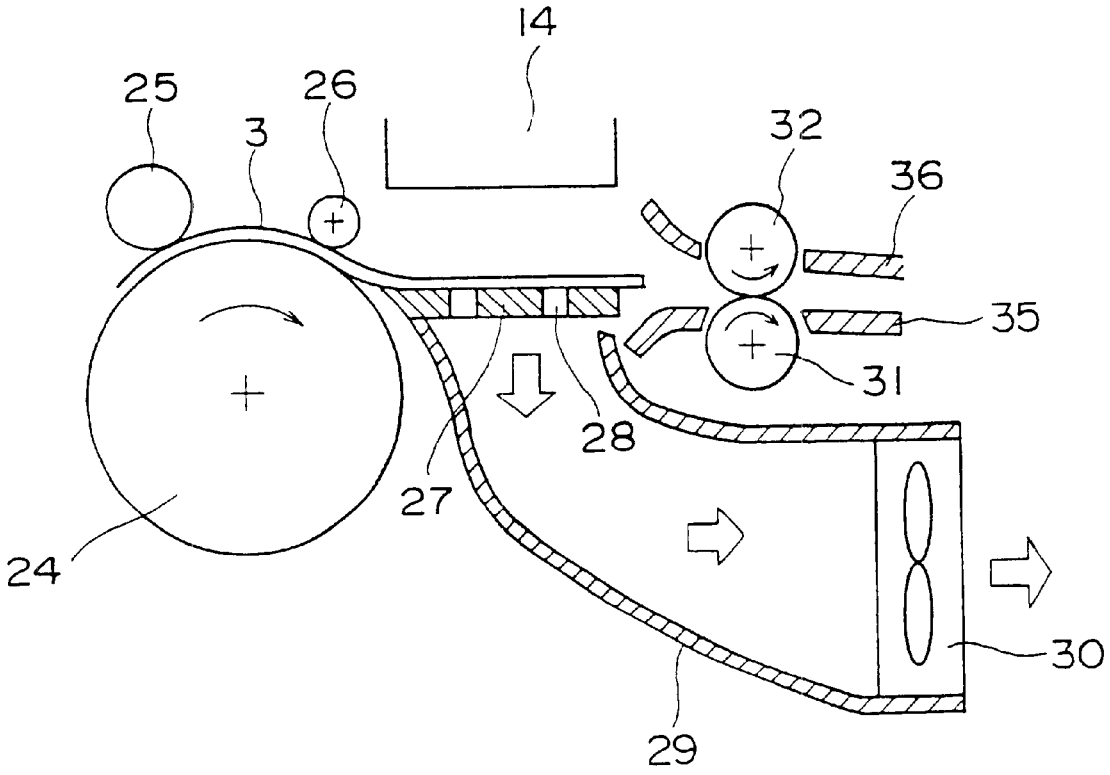
FIG. 2 is an enlarged cross-sectional view of an embodiment of a sheet transport mechanism in the ink-jet printing system of the present invention.

FIG. 2 shows an embodiment of a sheet transport mechanism in the ink-jet printing system of the present invention. In FIG. 2, the elements which are essentially the same as corresponding elements in FIG. 1 are designated by the same reference numerals.

As shown in FIG. 2, the sheet guide member 27 which is provided under the print head 14 has a number of air vents 28 formed therein. A duct 29 is attached to a bottom surface of the sheet guide member 27. A fan 30 is provided at the outlet of the duct 29. An internal space between the sheet guide member 27 and the fan 30 is enclosed by the duct 29, and the fan 30 generates a flow of air passing through the air vents 28 and out of the duct 29, as indicated by the arrows in FIG. 2. In the present embodiment, the sheet attracting member is constituted by the sheet guide member 27 with the air vents 28, the duct 29 and the fan 30. By the flow of air generated by the fan 30, the sheet attracting member pneumatically attracts the copy sheet 3 at the print position to the sheet guide member 27 during the transport of the copy sheet 3.

Referring back to FIG. 1, at the downstream end of the sheet guide member 27, a sheet ejection path which is formed by a pair of ejection guide plates 35 and 36 is provided. At the inlet of this sheet ejection path, a transport roller 31 and a spur roller 32 which are in contact with each other are provided to deliver the copy sheet 3, sent from the sheet guide member 27, through the sheet ejection path. At the outlet of the sheet ejection path, an ejection roller 33 and a spur roller 34 which are in contact with each other are provided to deliver the copy sheet 3, sent from the transport roller 31, to the ejection tray 6.

Figure 3:
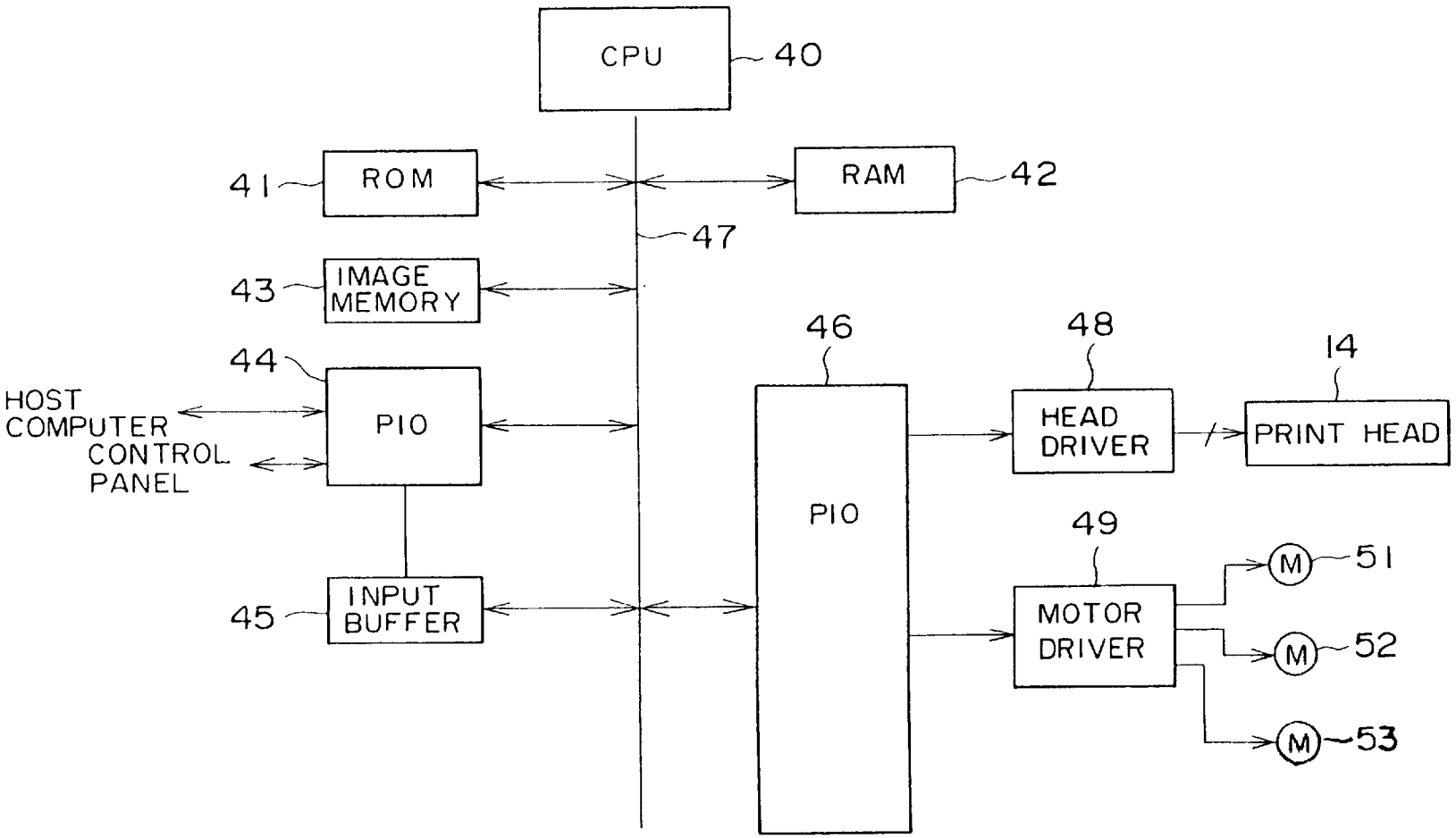
FIG. 3 is a block diagram of a control unit of the ink-jet printing system of the present invention.

FIG. 3 shows a control unit in the ink-jet printing system of the present invention.

The ink-jet printing system of the present invention is provided with a control unit which outputs a drive signal to a fan driving motor 53 so that the fan 30 generates the flow of air. The drive signal, output to the fan driving motor 53 by the control unit, is held in an ON state at least when a front edge or a rear edge of the copy sheet 3 is passing through the sheet guide member 27, allowing the copy sheet 3 to be pneumatically attracted to the sheet guide member 27 during the transport of the copy sheet 3.

As shown in FIG. 3, the control unit includes a central processing unit (CPU) 40 which controls the entire ink-jet printing system. A read-only memory (ROM) 41 which stores control information needed for the CPU 40 to control the printing system is connected to the CPU 40. A random access memory (RAM) 42 is connected to the CPU 40 and provides a working area available to the CPU 40. An image memory 43 is also connected to the CPU 40 and stores processed image information therein. A parallel input-output (PIO) port 44 connects the CPU 40 to each of a host computer (not shown) and a control panel (not shown) of the printing system. An input buffer 45 is connected to the PIO port 45, and temporarily stores input information supplied via the PIO port 44. The input buffer 45 is connected to the CPU 40. A parallel input-output (PIO) port (or a gate array) 46 connects the CPU 40 to each of a head driver 48 and a motor driver 49. The elements 40 through 46 of the control unit are interconnected by a bus 47.

In the control unit of FIG. 3, the image data supplied from the host computer, a dual-mode print command, a copy-sheet size parameter, various instructions supplied from the control panel, a home-position (or reference-position) signal supplied from a home-position sensor of the carriage 13, and the others, are transmitted to the CPU 40 via the PIO port 44. On the other hand, various status signals of the printing system supplied from the CPU 40 are transmitted to each of the host computer and the control panel via the PIO port 44.

In the control unit of FIG. 3, image data and control signals supplied via the PIO port 46 are transmitted to the print head 14 through the head driver 48. The print head 14 forms an image on the copy sheet by spraying ink onto the copy sheet through the nozzles of the print head 14 in accordance with the image data and the control signals. The print head 14 includes energy generating elements (such as piezoelectric elements) corresponding to the nozzles, and a waveform of the drive signal is supplied to the print head 14 by the head driver 48 to activate a corresponding one of the energy generating elements of the print head 14 so that the respective ink is sprayed through the corresponding nozzle onto the copy sheet. In this manner, an image is formed on the copy sheet by the print head 14. Any waveform of a rectangular pulse, a triangular pulse or a sine wave may be used as the waveform of the drive signal to activate the corresponding one of the energy generating elements of the print head 14.

Further, in the control unit of FIG. 3, drive signals supplied via the PIO port 46 are transmitted to any of a carriage driving motor 51, a transport-roller driving motor 52 and the fan driving motor 53 through the motor driver 49. The carriage driving motor 51 is driven to move the print head 14, mounted on the carriage 13, in the main scanning direction. The transport-roller driving motor 52 is driven to rotate the main transport roller 24 such that the copy sheet 3 at the print position is transported in the sub-scanning direction. The fan driving motor 53 is driven to rotate the fan 30 so as to generate the flow of air passing through the air vents 28 of the sheet guide member 27. As described above, the drive signal, output to the fan driving motor 53 by the control unit, is held in the ON state at least when the front edge or the rear edge of the copy sheet 3 is passing through the sheet guide member 27, which allows the copy sheet 3 to be pneumatically attracted to the sheet guide member 27 during the transport of the copy sheet 3.

In the above-described ink-jet printing system, the copy sheet 3, sent from the sheet cassette 4, is delivered by the main transport roller 24 and the intermediate roller 26 to the print position on the sheet guide member 27 provided under the print head 14. The print head 14 forms an image on the copy sheet 3 at the print position by spraying ink onto the copy sheet 3 through the nozzle of the print head 14. The copy sheet 3 with the image formed is further transported by the transport roller 31 and the spur roller 32 through the sheet ejection path to the ejection tray 6.

In the above-described ink-jet printing system, by the flow of air generated by the fan 30, the sheet attracting member pneumatically attracts the copy sheet 3 at the print position to the sheet guide member 27 during the transport of the copy sheet 3, as shown in FIG. 2. Even when the rear edge of the copy sheet 3 is not held by the intermediate roller 26, the front edge of the copy sheet 3 is held by the rollers 31 and 32 and the copy sheet 3 at the print position is pneumatically attracted to the sheet guide member 27 by the sheet attracting member. In the ink-jet printing system of the present embodiment, the sheet transport mechanism is constructed in a simple structure, and it is effective in maintaining the copy sheet 3 in a flat condition with respect to the print head 14 while transporting it at the print position during the image formation. The limitation of an effective print range of the print head 14 for the copy sheet 3 due to the restriction of the layout of the entire ink-jet printing system can be eliminated. It is possible to reliably prevent the copy sheet 3 from being set in a wavy or distorted condition during the image forming even when the rear edge of the copy sheet 3 is not held by the intermediate roller 26, and this makes it possible to obtain good quality of the reproduced image.

As is apparent from the construction of the above-described embodiment, in order to ensure the pneumatic attraction of the copy sheet 3 during the sheet transport, it is adequate to continuously hold the drive signal, output to the fan driving motor 53, in the ON state when the front edge or the rear edge of the copy sheet 3 is passing through the sheet guide member 27. As the time to drive the fan 30 can be minimized in such a manner, it is possible to reduce the noise due to the operation of the fan 30 while obtaining good quality of the reproduced image.

Figure 4:
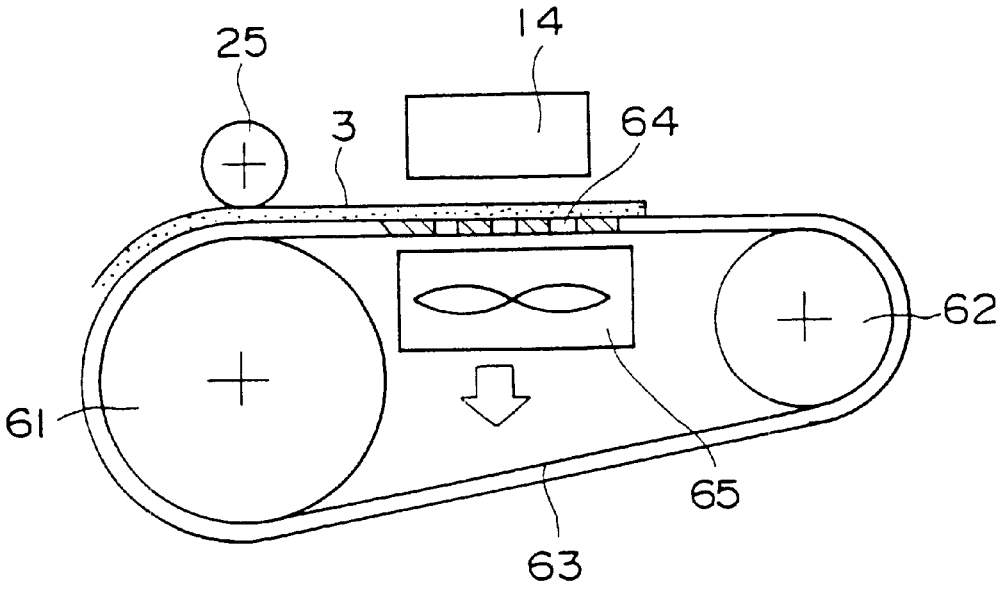
FIG. 4 is an enlarged cross-sectional view of another embodiment of the sheet transport mechanism in the ink-jet printing system of the present invention.

Next, FIG. 4 shows another embodiment of the sheet transport mechanism in the ink-jet printing system of the present invention.

Similar to the previous embodiment of FIG. 2, the sheet transport mechanism of the present embodiment can be applied to the ink-jet printing system of FIG. 1. In FIG. 4, the elements which are essentially the same as corresponding elements in FIG. 1 are designated by the same reference numerals, and a description thereof will be omitted.

As shown in FIG. 4, the sheet transport mechanism includes a transport belt 63 which is wound around both a main transport roller 61 and a transport follower roller 62. The main transport roller 61 is provided in this embodiment, instead of the main transport roller 24 of FIG. 1. The intermediate roller 25 is provided on the periphery of the main transport roller 61 at a position adjacent to the print head 14. The intermediate roller 26, as in the embodiment of FIG. 2, is not provided. The main transport roller 61, the intermediate roller 25 and the transport belt 63 serve to transport the copy sheet 3 at the print position in the sub-scanning direction during the image formation by the print head 14. The transport belt 63 has a number of air vents 64 formed for its entire length. A fan 65 is provided under a portion of the transport belt 63 confronting the print head 14. Similar to the embodiment of FIG. 2, the fan 65 generates a flow of air passing through the air vents 64 of the transport belt 63, as indicated by the arrow in FIG. 4. In the present embodiment, the sheet attracting member is constituted by the transport belt 63 with the air vents 64 and the fan 65. By the flow of air generated by the fan 65, the sheet attracting member pneumatically attracts the copy sheet 3 at the print position to the transport belt 63 during the transport of the copy sheet 3.

In the above-described sheet transport mechanism of FIG. 4, by the flow of air generated by the fan 65, the sheet attracting member pneumatically attracts the copy sheet 3 at the print position to the transport belt 63 during the transport of the copy sheet 3. Even when the rear edge of the copy sheet 3 is not held by the intermediate roller 25, the copy sheet 3 at the print position is pneumatically attracted to the transport belt 63. In the ink-jet printing system of the present embodiment, the sheet transport mechanism is constructed in a simple structure, and it is effective in maintaining the copy sheet 3 in a flat condition with respect to the print head 14 while transporting it at the print position during the image formation. It is possible to reliably prevent the copy sheet 3 from being set in a wavy or distorted condition during the image forming even when the rear edge of the copy sheet 3 is not held by the intermediate roller 25, and this makes it possible to obtain good quality of the reproduced image. As is apparent from the embodiment of FIG. 4, it is necessary to continuously hold the drive signal (which is output to a fan driving motor of the fan 65) in the ON state throughout the period of image formation by the print head 14.

Further, the present invention is not limited to the above-described embodiments, and variations and modifications may be made without departing from the scope of the present invention.

What is claimed is:

1. An ink-jet printing system comprising:

a print head for forming an image on a copy sheet at a print position by spraying ink onto the copy sheet through a nozzle of the head;

a fan;

a sheet transport mechanism for transporting the copy sheet along a sheet transport path while the image is formed on the copy sheet by the print head at a print position;

a sheet guide member provided opposite the print head at the print position to guide the transport of the copy sheet, and including a fixed stationary sheet attracting member which contacts the copy sheet during transport of the copy sheet and;

a duct extending from a bottom of the fixed sheet attracting member to the fan for pneumatically attracting the copy sheet to the fixed stationary sheet attracting member and maintaining the copy sheet in direct contact with the fixed stationary sheet attracting member during the transport of at least a portion of the copy sheet past the print position.

2. The ink-jet printing system of claim 1 wherein the fixed stationary sheet attracting member has a number of air vents formed therein, and the fan generates a flow of air passing through the air vents of the fixed stationary sheet attracting member which causes the copy sheet to be pneumatically attracted to the fixed stationary sheet attracting member.

3. The ink-jet printing system of claim 2 further comprising a control unit which outputs a drive signal to a fan driving motor so that the fan generates the flow of air, the drive signal being held in an ON state at least when one of a front edge or a rear edge of the copy sheet is passing through the sheet guide member, allowing the copy sheet to be pneumatically attracted to the sheet guide member.

4. The ink-jet printing system of claim 2 wherein the fan is arranged at an outlet of the duct, an internal space between the member and the fan being enclosed by the duct.

5. The ink-jet printing system of claim 1 wherein the sheet transport mechanism includes a main transport roller provided adjacent to an upstream end of the sheet guide member, and an intermediate roller provided on a periphery of the main transport roller.

6. An ink-jet printing system comprising:

a print head for forming an image on a copy sheet at a print position by spraying ink onto the copy sheet through a nozzle of the head;

a sheet transport mechanism for transporting the copy sheet along a sheet transport path while the image is formed on the copy sheet by the print head, the sheet transport mechanism including a transport belt which transports the copy sheet, the transport belt having a number of air vents formed therein, and the sheet transport mechanism including a sheet attracting member; and a fan provided under a portion of the transport belt confronting the print head which pneumatically attracts the copy sheet to the transport belt during the transport of the copy sheet, by generating a flow of air passing only through the air vents of the transport belt immediately opposite the print head so that the copy sheet is transported only by the transport belt during at least a portion of the transport of the copy sheet.

7. The ink-jet printing system of claim 6 further comprising a control unit which outputs a drive signal to a fan driving motor during the image formation by the print head, so that the fan generates the flow of air, allowing the copy sheet to be pneumatically attracted to the transport belt.

8. An inkjet printing method comprising steps of:

forming an image on a copy sheet at a print position by spraying ink onto the copy sheet through a nozzle of a print head;

transporting the copy sheet along a sheet transport path while the image is formed on the copy sheet by the print head at a print position;

guiding the transport of the copy sheet using a sheet guide member including a fixed stationary sheet attracting member which contacts the copy sheet during transport of the copy sheet, provided opposite the print head at the print position; and pneumatically attracting the copy sheet to the fixed stationary sheet attracting member and maintaining the copy sheet in direct contact with the fixed stationary sheet attracting member during the transport of at least a portion of the copy sheet past the print position.

9. An ink-jet printing method comprising steps of:

forming an image on a copy sheet at a print position by spraying ink onto the copy sheet through a nozzle of a print head; and transporting the copy sheet along a sheet transport path while the image is formed on the copy sheet by the print head using a sheet transport mechanism including a transport belt which transports the copy sheet, the transport belt having a number of air vents formed therein; and pneumatically attracting the copy sheet to the transport belt using a sheet attracting member during the transport of the copy sheet, by operating a fan provided under a portion of the transport belt confronting the print head for generating a flow of air passing only through the air vents of the transport belt immediately opposite the print head so that the copy sheet is transported only by the transport belt during at least a portion of the transport of the copy sheet.

* * * * *